US005431190A

United States Patent [19]

Tonk

[11] Patent Number: 5,431,190

[45] Date of Patent: Jul. 11, 1995

[54] DEVICE FOR SUCKING ADDITIVES INTO A FLUID STREAM

[76] Inventor: Kurt Tonk, Hohlstrasse 11, D-5473 Kruft, Germany

[21] Appl. No.: 196,190

[22] PCT Filed: Aug. 21, 1992

[86] PCT No.: PCT/DE92/00699

§ 371 Date: Mar. 24, 1994

§ 102(e) Date: Mar. 24, 1994

[87] PCT Pub. No.: WO93/03830

PCT Pub. Date: Mar. 4, 1993

[30] Foreign Application Priority Data

Aug. 23, 1991 [DE] Germany ..... 41 28 006.7

[51] Int. Cl.[6] ..... B01F 5/04

[52] U.S. Cl. ..... 137/893; 137/888

[58] Field of Search ..... 137/888, 893, 894

[56] References Cited

FOREIGN PATENT DOCUMENTS 965375 9/1950 France .

399290 7/1924 Germany .

3930709 1/1990 Germany .

*Primary Examiner*—Robert G. Nilson

*Attorney, Agent, or Firm*—Panitch Schwarze Jacobs & Nadel

[57] ABSTRACT

The invention involves an apparatus for the induction and admixture of additives into a fluid stream by means of a joining piece, whereby a plug projects into the fluid stream and blocks a major part of the stream cross-section. This plug exhibits, in the area of the flow-through gap, an opening that is joined with a connecting conduit for the additive that is to be inducted. It is fundamental that the gap cross-sections for the fluid steam on both sides of the plug are of differing sizes.

15 Claims, 2 Drawing Sheets

DEVICE FOR SUCKING ADDITIVES INTO A FLUID STREAM

FIELD OF THE INVENTION

The invention involves an apparatus for the induction and admixture of additives into a fluid stream by means of a joining piece that exhibits a through conduit for the fluid and a connecting conduit, which is joined with the through conduit, for the additive, whereby the additive is inducted by means of a negative pressure that is generated by the fluid stream, while a plug projects into the through conduit approximately transversely to the fluid stream, and this plug blocks a major part of the fluid stream, however, it can be bypassed by the flow to the side, longitudinally, through at least one gap, and at that place exhibits at least one opening that is joined with the connecting conduit for the additive.

BACKGROUND OF THE INVENTION

An apparatus of such a type is known through DE-OS 39 30 709 from the same applicant. It is distinguished by surprisingly high suction power at the connecting conduit for the additive, so that even the admixture of viscous, gelatinous media of high viscosity is assured. As the fluid in this regard, basically any liquid or gaseous medium comes into consideration.

Studies by the applicant have shown that suction action abates if the fluid that has been mixed with the additive must subsequently overcome high flow resistances, that is, if high back pressures downstream of the mixing apparatus have to be taken into account. In practice, this occurs, for example, if downstream of the mixing apparatus the fluid is to be atomized into the atmosphere or into a combustion chamber by means of fine jets.

SUMMARY OF THE INVENTION

Beginning from this point, the task of the invention lies in further improving the apparatus described at the beginning with respect to its suction power. In doing this, it should also be distinguished through a strong negative pressure at the connecting conduit for the additive, even if there are high back pressures. If, for example, an admission pressure of 6 bar is being used in the fluid, then the apparatus in accordance with the invention should tolerate a back pressure of 4 to 5 bar without the suction power abating significantly.

The resolution of this task succeeds in accordance with the invention by virtue of the fact that the gap cross-section for the fluid stream is selected in differing sizes at the two sides of the plug, and specifically, so that the gap cross-section on one side of the plug is, at the most, half as large as the one on the other side of the plug, and in the limit case, even approximately zero.

With this asymmetric arrangement, it has been shown, surprisingly, that the suction power is even higher than with the known apparatus described at the beginning, and that because of that, even higher back pressures in the outgoing line can be tolerated.

Possibly, this is based on the fact that the smaller flow-through gap provides for a higher suction power, while the larger flow-through gap allows a high flow-through quantity. If the plug is displaced to the extent that it can still be bypassed by the flow only on one side, then, along with the high suction power, a strong turbulence also appears and, in accordance with that, a good mixing of the fluid and additive as well.

As was already the case with the apparatus that was previously known, the dimensioning of the gap cross-section is of considerable importance here as well. It is advisable that the gap cross-section, or the total of the two cross-sections if the plug is being bypassed by the flow on both sides, amounts to approximately 5 percent to 8 percent of the fluid conduit cross-section.

In addition, it has proven to be advantageous if the plug exhibits an approximately round cross-section and projects on one side of the plug tangentially into the through conduit, or cuts into the neighboring wall of the through conduit with an undercut of approximately 1 mm—preferably ½ mm. In other words, the bore for the plug is displaced in a transverse direction relative to the axis of the fluid conduit by approximately 15 to 25 percent relative to the diameter of the fluid conduit. When this is done, it has been shown that the formation of dead space at the closed side does not impair the suction power in any way, but that, on the contrary, the distribution of the additive in the fluid is improved.

With regard to the openings in the plug for the additive, it is advisable to displace them, with reference to a transverse plane through the fluid conduit along the plug axis, ahead in the flow direction by approximately 8° to 12°, preferably by approximately 10°.

Another expedient further development of the invention consists in the fact that the plug completely traverses the walls of the through conduit and is fixed in a manner that is always fluid-tight. Depending on the material, it can be glued, sealed, soldered or welded. In each case, one achieves through this fixing of the plug to both sides of the through conduit a very exact positioning, which is important in maintaining the desired gap cross-sections.

In a corresponding way, it is also advisable that the plug be secured against turning so that the plug can be installed into the joining piece only in a position of such a nature that the openings from which the additive is inducted lie at the correct angle.

The installing of the plug into the joining piece is best done in such a way that it is inserted into the joining piece from the side opposite the connecting conduit for the additive, whereby it can exhibit on this opposite side a projection that fits into a corresponding recess of the joining piece.

Finally, it has proven to be beneficial that the joining piece exhibits in its connecting conduit a valve, consisting of a valve seat and a valve body, the installation position of which is selected in such a way that, in the event of negative pressure at the opening for the additive, it is loaded in an opening direction, and in the event of positive pressure at the opening for the additive, it is loaded in a closing direction. In this way, it is ensured that in the event of a possible blockage in the outgoing line, the fluid does not flow into the connecting conduit of the additive and cause impurities there.

This is especially important if the fluid that is being used is heating oil that is to be mixed with air in the joining piece in order to improve combustion.

For safety reasons, the valve body can in addition be loaded in the closing direction by means of a spring.

BRIEF DESCRIPTION OF THE DRAWINGS

Additional features and advantages of the object of the application can be drawn from the following description of an implementation example with the aid of the drawing. The following are shown.

DETAILED DESCRIPTION OF THE PREFERRED EMBODIMENT

Figure 1:
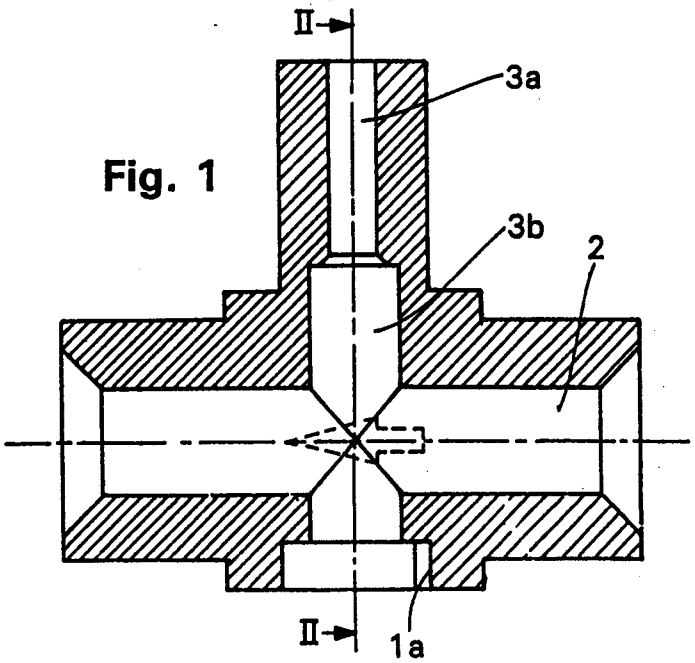
FIG. 1 The empty joining piece in an axial section along the through conduit.
Figure 4:
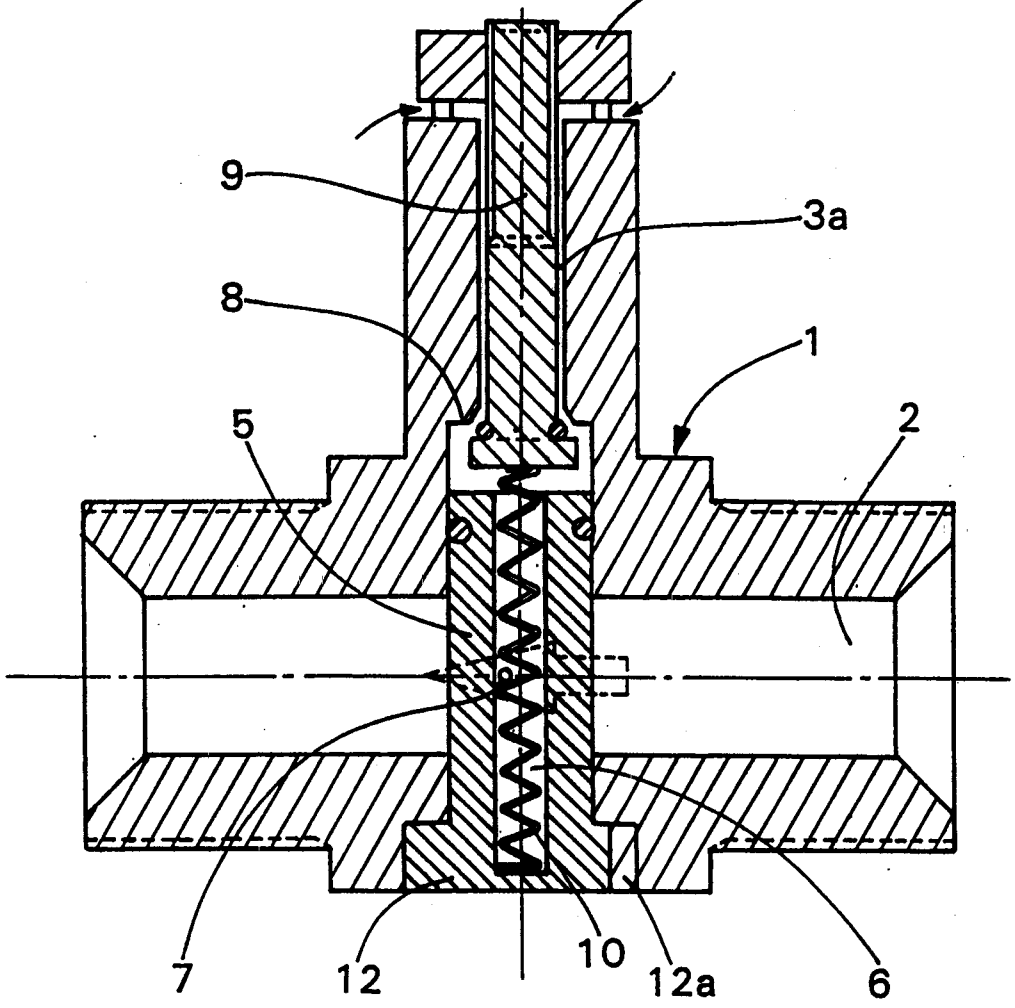
FIG. 4 An enlarged axial section in accordance with FIG. 1, but with the installed parts.

As FIGS. 1 and 4 show in particular, the T-shaped joining piece 1 includes a horizontal bore for the through conduit 2, and, emptying vertically into this conduit, a vertical bore 3 that functions in its upper portion 3*a* as a connecting conduit for the additive, while in its lower portion 3*b*, it serves to seat a plug, which will be discussed in more detail later.

Now, it is fundamental that the axes of the bores 2 and 3*b* do not intersect, but are displaced relative to one another. In accordance with FIG. 2, the bore 3*b* is displaced in a transverse direction in such a way that it is approximately tangential to the left wall of the through conduit 2, whereas it cuts approximately 1 to 2 mm deep into the right wall. As a result, an approximately sickle-shaped gap 4 is created there.

If the plug 5 shown in FIG. 4 is now inserted into the joining piece 1 from below, then this plug can only be bypassed by the flow on one side, namely, along the gap 4, while the through conduit on the other side of the plug is blocked.

The additive is fed in via the connecting conduit 3*a*. It makes its way through a bore 6 in the plug 5 into the inside of the plug, and is then inducted from there and entrained by the fluid via at least one opening 7 that has its outlet at the gap 4, and is displaced by approximately 10 degrees of angle in the direction of the flow, the direction of flow in conduit 2 being indicated by the phantom arrow in FIGS. 1 and 4.

The upper portion 3*a* of the bore 3 is reduced in diameter with reference to the portion 3*b* while forming a valve seat 8, and bears in its interior a valve body 9, which, by means of a sealing ring, operates in conjunction with the valve seat 8. It is able to be moved vertically in the bore 3*a*, kept by an annular passage, but is pressed upward into the closed position by means of a spring 10 that is mounted in the bore 6 of the plug 5.

At its upper end, the valve body 9 carries a stop ring 11 that is rotatable on a screw thread. Its clearance with respect to the upper end of the joining piece 1 defines the maximum opening travel of the valve body 9, and thereby makes it possible to regulate the quantity of the additive that is inducted by the fluid.

Figure 2:
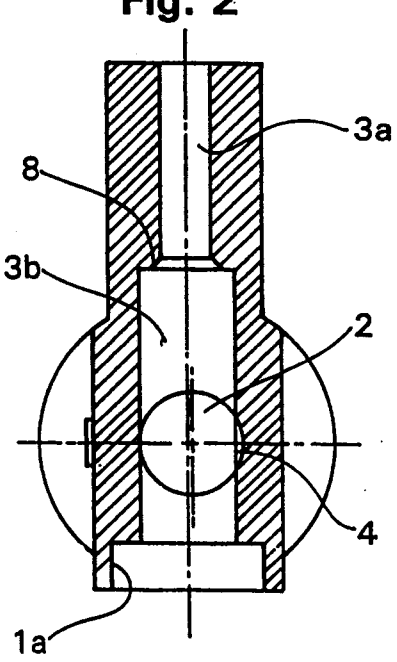
FIG. 2 A cross-section through the line II—II in FIG. 1.
Figure 3:
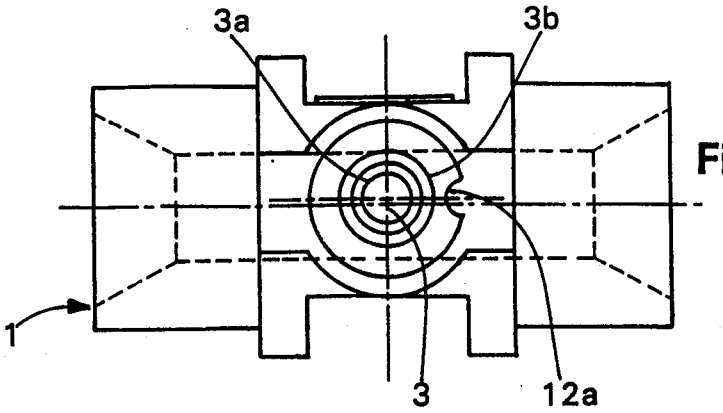
FIG. 3 A bottom view of the joining piece in accordance with FIG. 1.

In order to ensure the properly fitting installation of the plug 5 in the joining piece 1, the plug bears at its lower end an encircling projection 12 that—as FIGS. 1 and 2 show—fits into a matching recess 1*a* in the joining piece and is therein secured in a fluid-tight manner. At the same time, a locking piston 12*a* ensures that the plug can only be installed in one specific position, in which the opening 7, relative to the direction of flow, is slightly displaced in the direction towards the outgoing fluid.

In principle, the described apparatus is suitable for all applications in which a liquid or a gas is to be mixed into a liquid or gaseous fluid.

Installation in the heating oil supply of burners has proven to be particularly successful. In this case, the heating oil flows through the through conduit 2 and inducts fresh air via the connecting conduit 3*a*. This fresh air is intensively mixed with the heating oil, whereby the heating oil experiences an intensive preatomization.

The Rhineland TÜV [Technical Monitoring Association] has determined that the flame temperature increases significantly, and the combustion of the heating oil is improved. Measurements by the Rhineland TÜV showed an astonishingly high savings of 10 to 15 percent in heating oil. At the same time, the emission of pollutants was drastically reduced.

I claim:

1. Apparatus for the induction and admixture of additives into a fluid stream by means of a joining piece (1) that exhibits a through conduit (2) for the fluid and a connecting conduit (3*a*), which is joined with the through conduit, for the additive, whereby the additive is inducted by means of a negative pressure that is generated by the fluid stream, while a plug (5) projects into the through conduit (2) approximately transversely to the fluid stream, and this plug (5) blocks a major part of the fluid stream, however, it can be bypassed by the flow to the side, longitudinally, through at least one gap (4), and at that place exhibits at least one opening (7) that is joined with the connecting conduit (3*a*) for the additive, characterized by the fact that the gap cross-sections (4) for the fluid steam on the two sides of the plug (5) are of differing sizes.

2. Apparatus in accordance with claim 1, characterized by the fact that the gap cross-section on one side of the plug is, at the most, half as large as the one on the other side of the plug.

3. Apparatus in accordance with claim 1, characterized by the fact that the gap cross-section on one side of the plug is approximately zero, and that the gap cross-section (4) on the other side of the plug amounts to approximately 5 to 8 percent of the fluid conduit cross-section.

4. Apparatus in accordance with claim 1 characterized by the fact that the plug (5) exhibits an approximately round cross-section, and on one side of the plug projects tangentially into the through conduit (2) for the fluid, while it forms a gap (4) on the other side.

5. Apparatus in accordance with claim 1, characterized by the fact that the plug (5) exhibits an approximately round cross-section, and at one side of the plug cuts into the neighboring wall of the through conduit with an undercut of approximately 1 mm, while it forms a gap (4) on the other side.

6. Apparatus in accordance with claim 5, wherein the undercut is approximately ½ mm.

7. Apparatus in accordance with claim 1, characterized by the fact that the opening (7) in the plug (5) is displaced, with reference to a transverse plane through the through conduit (2) along the plug axis, ahead in the flow direction by approximately 8° to 12°.

8. Apparatus in accordance with claim 1, characterized by the fact that the plug (5) completely traverses the walls of the through conduit (2) and is fixed in a manner that is always fluid-tight.

9. Apparatus in accordance with claim 1, characterized by the fact that the plug (5) is secured against turning by a positive-fit engagement (12*a*) with the joining piece (1).

10. Apparatus in accordance with claim 1, characterized by the fact that the plug (5) can be inserted into the joining piece (1) from the side opposite the connecting conduit (3*a*) for the additive.

11. Apparatus in accordance with claim 1, characterized by the fact that the plug (5) exhibits on the side opposite the connecting conduit (3*a*) an encircling projection (12) that fits into a matching recess (1*a*) in the joining piece (1).

12. Apparatus in accordance with claim 1, characterized by the fact that the joining piece (1) exhibits in its connecting conduit (3*a*) a valve seat (8) and a valve body (9), the installation position of which is selected in such a way that, in the event of negative pressure at the opening (7) for the additive, it is loaded in an opening direction, and in the event of positive pressure at the opening (7) for the additive, it is loaded in a closing direction.

13. Apparatus in accordance with claim 12, characterized by the fact that the valve body (9) is additionally loaded in the closing direction by means of a spring (10).

14. Apparatus in accordance with claim 13, characterized by the fact that the spring (10) is accommodated in a bore (6) of the plug (5).

15. Apparatus in accordance with claim 12, characterized by the fact that the valve seat (8) is formed directly into the connecting conduit (3*a*).

* * * * *